US006293395B1

(12) United States Patent
Hof

(10) Patent No.: US 6,293,395 B1
(45) Date of Patent: Sep. 25, 2001

(54) PACKAGING FOR MIXING A PRODUCT CONTAINING SEVERAL COMPONENTS

(75) Inventor: Robert Hof, Survilliers (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/503,495

(22) Filed: Feb. 14, 2000

(30) Foreign Application Priority Data

Feb. 22, 1999 (FR) ..... 99 02171

(51) Int. Cl.[7] ..... B65D 25/08
(52) U.S. Cl. ..... 206/219; 206/221
(58) Field of Search ..... 206/219, 221, 206/222; 215/DIG. 8

(56) References Cited

U.S. PATENT DOCUMENTS 5,277,303 * 1/1994 Goyet et al. ..... 206/221
5,908,107 * 6/1999 Baudin ..... 206/221
5,992,693 * 11/1999 Albisetti ..... 206/221

FOREIGN PATENT DOCUMENTS 198 12 657 12/1998 (DE) .
0 528 707 2/1993 (EP) .
1 542 467 10/1968 (FR) .
2 763 048 11/1998 (FR) .
2009089 6/1979 (GB) .

* cited by examiner

*Primary Examiner*—David T. Fidei
(74) *Attorney, Agent, or Firm*—Oblon,Spivak, McClelland, Maier & Neustadt, P.C.

(57) ABSTRACT

Packaging (1) for the extemporaneous mixing of two products (A, B) includes a first bottle (6) intended to contain a first product (A), this bottle being open at its base (12) in the form of a skirt (7) and being fitted with a dispensing nozzle (36); a connecting part (10) fixed to the base (12) of the first bottle (6), including a central hollow shaft (14) capable of receiving a first detachable stopper (16) allowing the first bottle to be closed; a second bottle (5) intended to contain a second product (B), provided with a neck (18) which can be engaged in the central hollow shaft (14), the second bottle (5) being equipped with a removable closure (26) and bearing an engagement part (48) which, after the closure (26) has been removed, interacts with a complementary part (46) provided in the central hollow shaft (14), to allow the first stopper (16) to be expelled and allow the two products (A+B) to be mixed. The second bottle (5) includes an intermediate member (20) which can participate with the closure (26) in order, on removing the closure (26), to carry out the mixing of at least two base compositions ($B_1$, $B_2$) separately contained in the second bottle (5) so as to form the second product (B).

22 Claims, 5 Drawing Sheets

PACKAGING FOR MIXING A PRODUCT CONTAINING SEVERAL COMPONENTS

BACKGROUND OF THE INVENTION

1. Field of the Invention

The present invention relates to packaging allowing three components of a product, for example liquids, to be stored separately from each other, and allowing them to be mixed at the time of their use. This packaging can be used, for example, for the storage of a hair dye or of a hair-perming product, these products usually consisting of several components.

2. Description of the Related Art

Two-part packaging allowing two components to be stored and extemporaneously mixed just before the use of the mixture is described in EP-A-0,298,357. This packaging comprises a first bottle intended to contain a first component, this bottle being open at its base and fitted at its top with a dispensing nozzle; connecting part fixed to the base of the first bottle and comprising a central hollow shaft capable of receiving, at the top, a removable stopper allowing the first bottle to be closed; a second bottle intended to contain a second product, provided with a neck which can be engaged in the central hollow shaft, this neck being equipped with a closure plug for storage, connecting part, in particular of the screwing type, provided between the neck and the plug, the assembly being such that when the plug is removed from the second bottle, the neck of the second bottle can expel the stopper to allow the components to be mixed.

Moreover, DE GM 8700341 describes packaging for the separate storage of three components to be mixed at the time of use. This packaging comprises a cylindrical upper first container fitted with a dispensing nozzle and containing a first component; a cylindrical lower body provided with a bottom to which two concentric cylinders of the same height are connected, the lower cylinder constituting a second container which contains a second component, and a third container bounded by the volume defined between the two cylinders and the bottom, and containing a third component. A plug having two annular skirts is provided for simultaneously closing off the second and third compartments. The plug includes a plurality of radial fins intended to catch on an internal rim of the first container when the first container undergoes a relative translational movement with respect to the second container, for the purpose of disconnecting the plug from the second and the third containers and thus of mixing the three components.

It has been found that the plug frequently remains caught on the second and third containers and that the mixing of the three components could therefore not be carried out. Moreover, certain multi-component formulations such as those intended for use with the present invention require the mixing of the various components to be carried out according to a sequence of precise steps. This is because, for example, in the case of certain recently developed formulations, it is absolutely essential to proceed via a premixing of two or more base compositions before another active component is added.

SUMMARY OF THE INVENTION

Thus, it is an object of the present invention to provide packaging of the abovementioned kind, which especially allows the mixing of a product consisting of three components.

Another object of the present invention is to provide packaging for a multi-component product the manufacture of which remains simple and as inexpensive as possible, and which allows storage under reliable sealing conditions. This packaging must be made as small as possible and allow simple and rapid assembly. By virtue of the invention, it is possible to completely safely package several components, for example of a corrosive nature, for a prolonged storage period, these components having to come into contact with each other only at the moment of use.

Such packaging can be used, in particular, for a hair dye, for example an oxidation-type dye, or else for a hair-perming product.

It is known that this kind of product generally consists of at least two base compositions. In general, such a product comprises an active component combined with a reducing agent or an oxidizing agent. The active component has to be stored separately from the reducing agent or the oxidizing agent in order to prevent premature inactivation of the active component. However, when it is desirable to add an additional component, for example a fragrance intended to mask the smell of one of the components, or a solubilizing agent, or even an emulsifier, in order to make it easier for the mixture to be homogenized, it is not possible to package the additional component with one or other of the base compositions. This is because the premature contacting of these components would cause the product to degrade before it is used.

Thus, the invention comprises a packaging for the extemporaneous mixing of two products, comprising a first bottle intended to contain a first product, this bottle being open at its base in the form of a skirt and being fitted with a dispensing nozzle; connecting part fixed to the base of the first bottle and comprising a central hollow shaft capable of receiving a first detachable stopper allowing the first bottle to be closed; a second bottle intended to contain a second product and provided with a neck which can be engaged in the central hollow shaft, the second bottle being equipped with a removable closure and bearing engagement means which, after the closure has been removed, interact with a complementary part provided in the central hollow shaft, to allow the first stopper to be expelled and allow the two products to be mixed.

According to the invention, in such a packaging the second bottle includes an intermediate member which can participate with the closure in order, on removing the closure, to carry out the mixing of at least two base compositions separately contained in the second bottle so as to form the second product.

In other words, by virtue of the packaging of the invention it is possible, in a first step, to pre-mix two base compositions in order to obtain the second product. In a second step, the first product can be added to the pre-mixture thus obtained, in order to obtain a mixture of the three components in a defined order, ready for use.

In a preferred embodiment, the intermediate member comprises a skirt which is inserted into the neck of the container of the second bottle and a free edge of which, placed inside the neck, is intended to come into engagement with a second stopper carried by the closure and isolating one of the base compositions from the other. By this arrangement, it is possible to superpose the two base compositions, one with respect to the other, thereby allowing them to be mixed under gravity after the second stopper has been expelled.

Advantageously, the skirt presents a portion emerging from the container of the second bottle and including a screw thread which can interact with a corresponding screw thread carried by the closure. Thus, by simply unscrewing the closure it is possible to cause the second stopper to be disengaged and the two base compositions to be premixed.

Moreover, unless otherwise indicated, the screwing systems used for joining the assembly together preferably have a "right-handed" screw thread.

When it is difficult to mix the first product contained in the first bottle with one of the two base compositions, for example for solubility reasons, the nature of the other of the base compositions may be chosen so as to obtain a co-solubilizing effect.

According to an advantageous feature of the invention, the closure is in the form of a stopper and carries a central tubular portion which (i) passes through the inside of the first skirt over its entire height and (ii) has a free end which is closed off by the second stopper, thus defining a compartment which can contain one of the base compositions.

In this case, the second stopper advantageously presents a projecting peripheral edge which can butt against the free edge of the first skirt so that, when the closure has been removed from the second bottle, the second stopper is expelled, allowing the base compositions to be mixed.

Preferably, the engagement means are carried by the intermediate member. In this case, the engagement means may be carried by a second skirt which is placed on the outside around the neck of the second bottle and an inner surface of which includes a screw thread capable of interacting with a corresponding screw thread formed on the neck.

These engagement means advantageously comprise at least one stub or a screw thread portion projecting radially outwards, complementary parts being provided on the internal surface of the central hollow shaft. Such complementary parts may comprise at least one helical ramp which can interact with the stub or the screw thread portion.

According to a preferred embodiment, the engagement means comprise two diametrically opposed stubs, the complementary parts comprising two diametrically opposed helical ramps.

The interaction between the engagement means and the complementary part causes the intermediate member to move axially inside the central hollow shaft in response to the second bottle being rotated with respect to the first. For reasons of ease of use, the pitch of the or each helical ramp may be such that the axial movement of the intermediate member relative to the central hollow shaft, necessary for expelling the first stopper, is obtained by rotating the second bottle through at least one turn with respect to the first.

Moreover, "anti-rotation" parts may be provided which, after the intermediate member has been screwed onto the neck of the second bottle, prevent the intermediate member from rotating with respect to the second bottle. Thus, when unscrewing the closure, the intermediate member is prevented from becoming disconnected from the neck of the second bottle. Of course, these "anti-rotation" parts may not exist when the system for screwing the intermediate member onto the neck of the second bottle has a "left-handed" screw thread.

It should be noted that the second bottle advantageously consists of a lower container which includes the neck and is made, in particular, of glass or of polyvinyl chloride (PVC). In this case, the neck is surmounted by the intermediate member provided with an upper compartment.

Preferably, the first stopper is snap-fastened on to the top of the central hollow shaft. Likewise, the second stopper is advantageously snap-fastened on to the free end of the tubular portion of the closure (or plug).

Advantageously, a sealing lip may be placed on an internal surface of the top of the central hollow shaft so as to provide a good seal between the internal surface and the first skirt when the first skirt is in the position for expelling the first stopper.

According to another advantageous aspect of the invention, the internal diameter of the bottom of the central hollow shaft is large enough to allow entry of at least part of the second skirt of the intermediate member and of at least part of the closure. By means of this arrangement, it is possible to produce a particularly compact packaging for the assembly.

According to one embodiment, the connecting part consist of a member forming a U-shaped annular groove, and formed from an inner wall, consisting of at least a portion of the central hollow shaft, an outer wall and a bottom connecting the inner wall to the outer wall. The inner wall is extended by a smaller-diameter extension forming the top of the central hollow shaft. The internal surface of the outer wall includes a screw thread capable of interacting with a corresponding screw thread provided on the base of the first bottle.

Advantageously, a sealing lip is placed in the bottom of the U-shaped groove, between the inner wall and the outer wall, the sealing lip having a profile capable of interacting in a sealed manner with the base of the first bottle so as to provide a good seal between the first bottle and the outside.

The first container may communicate, at its top, with a dispensing nozzle which is closed by a breakable tip. After having mixed all the components of the assembly, the user breaks this tip, thus freeing a dispensing channel for applying the mixture obtained at the desired point.

Advantageously, the first container is made of a compressible thermoplastic. Thus by directing the open application nozzle to the point to be treated, and by pressing on the walls of the first container with greater or lesser strength, the user can deliver the desired amount of dispensed product.

The intermediate member and the connecting part may be made of a thermoplastic chosen from polyethylenes (PE), polypropylenes (PP), polyethylene terephthalate (PET), polyvinyl chlorides (PVC), or of a complex of the polyethylene/ethylene-vinyl alcohol (PE/EVOH) or PE/PET type.

According to one particularly preferred embodiment, this packaging is intended to contain a hair dye, the first bottle containing an oxidizing agent and the second bottle containing a colorant and an oil or a fragrance, respectively. Advantageously, the colorant is placed in the lower container and the oil or fragrance is in the upper compartment.

By virtue of the arrangement of the packaging of the invention, it is possible to ensure that the components of the product are properly preserved during storage and/or transportation and for a long period of preservation.

The components may be mixed in a defined order, on the one hand without loss of product to the outside, and on the other hand without one of the components coming adventitiously into contact with any one of the other components.

BRIEF DESCRIPTION OF THE DRAWINGS

In order to make the present invention more clearly understood, a description will now be given, by way of purely illustrative and entirely non-limiting example, of an embodiment of packaging according to the invention, shown in the appended drawings, in which.

DETAILED DESCRIPTION OF THE PREFERRED EMBODIMENT

Figure 1:
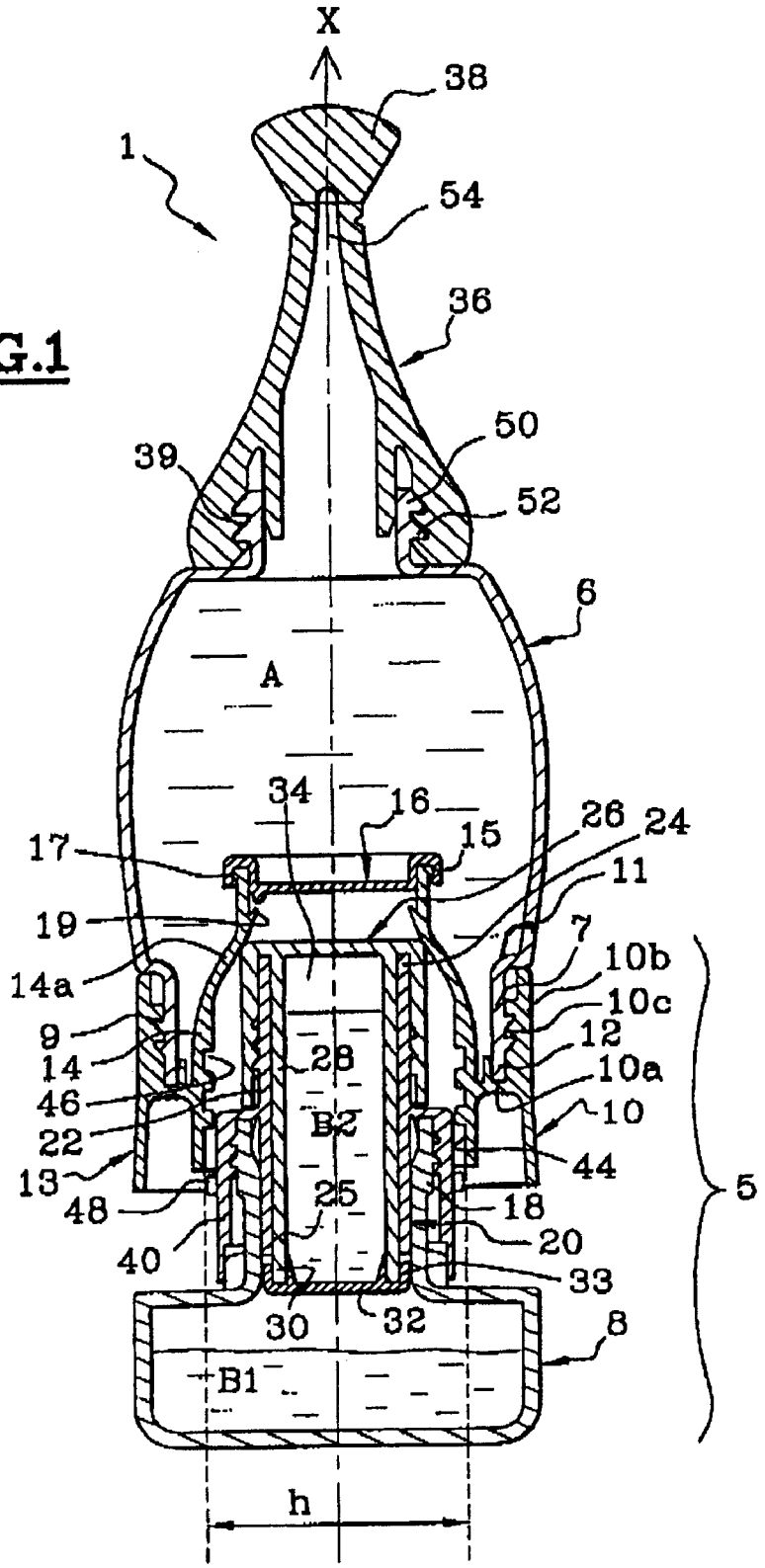
FIG. 1 shows an axial sectional view of two-part packaging containing three components, in the storage position.

Referring to the drawings, especially to FIG. 1, packaging 1 is made of two parts having a longitudinal axis X and allowing three components A, B1, B2 of a product to be stored separately from each other. These components are generally liquid and have to be mixed just before they are used. In the example in question the product is a hair dye.

The first part of the assembly comprises a bottle 6, equipped with a dispensing nozzle 36 and a connecting part 10. The bottle 6 contains a first product A, for example an oxidizing agent, intended to be mixed at the time of use with a second product B. The product B is a composition resulting from extemporaneous mixing of two base compositions $B_1$ and $B_2$. These base compositions are packaged separately in a lower bottle 5.

The base composition $B_1$ is, for example, a precursor for an oxidation colorant and the base composition $B_2$ may be an oil, a fragrance, a cosolubilizer or an emulsifier.

The component $B_1$ is placed in a lower container 8 provided with a neck 18. The component $B_2$ is packaged in a container 34 formed by a tubular portion 28 forming part of a plug 26 and of a removable stopper 32. The plug 26 constitutes a removable closure and is fitted onto an intermediate member 20. This intermediate member 20 includes a first cylindrical skirt 22 whose internal diameter corresponds approximately to the external diameter of the tubular portion 28 of the plug 26, to within the clearance necessary for ensuring that the plug can move in the intermediate member 20. The tubular portion 28 passes through the skirt 22 over its entire height and has a free end 30 emergent with respect to the skirt 22, the removable stopper 32 being fastened to this free end 30. The subassembly, consisting of the intermediate member 20, the plug 26, the stopper 32 and the lower container 8, forms the second bottle 5.

The intermediate member 20 has parts 40, 41, 18*a*, 40*b* (see FIG. 3) for allowing it to be irreversibly fastened onto the neck 18 of the lower container 8. These parts for fastening the intermediate member 20 comprise a second, outer cylindrical skirt 40, concentric with the first skirt 22. The outer skirt 40 has a portion 40*a* (FIG. 3) extending radially towards the X axis and joining the first skirt 22 approximately half-way up the first skirt. This second skirt 40 has a free edge facing the second bottle 8 and defines, with roughly the lower half of the first skirt 22, an annular groove which can receive the neck 18 of the bottle 8.

Figure 2:
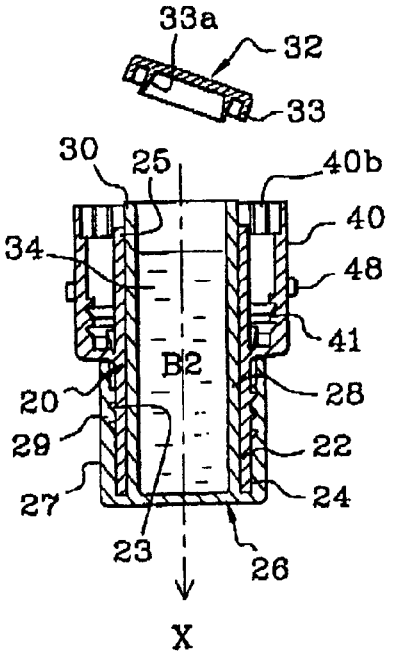
FIG. 2 shows a view illustrating the packaging of a base composition ($B_2$) in an intermediate member.

The intermediate member 20 is screwed onto the neck 18 by means of an external screw thread 42 on the neck 18 interacting with a complementary screw thread 41 made on the internal surface of the second skirt 40. In order to ensure that this fastening arrangement cannot be unfastened, the base of the neck 18 is provided with anti-unscrewing catches 18*a* which are uniformly distributed around its periphery. These catches 18*a* interact with complementary catches 40*b* (see FIGS. 2 and 3) carried by the lower end of the second skirt 40.

Moreover, the external wall of the skirt 40 carries engagement means 48, consisting of two diametrically opposed stubs, the purpose of which will be explained below.

As regards the removable stopper 32, when applied to the plug 26 it has a peripheral edge 33 projecting from the outer surface of the tubular portion 28 so as to butt against a free end 25 of the first skirt 22 (FIG. 3) so that, when the plug 26 is removed from the intermediate member 20, the stopper 32 is released from the free end 30 of the plug 26.

The plug 26 includes an external screwing bush 27 (FIG. 3) concentric with the tubular portion 28 and provided with an internal screw thread 29. The internal screw thread 29 can interact with a complementary external screw thread 23 carried by an emergent portion 24 of the first cylindrical skirt 22.

The first bottle 6 is open at its base 12, which base consists of a first cylindrical neck 7 with an external screw thread 9. The neck 7 is connected to the body of the bottle 6 by a shoulder 11. A second neck 50, of smaller diameter than the diameter of the first neck 7, is placed at the top of the bottle 6, on the opposite side from the first neck 7. The second neck 50 is provided with an external screw thread 52 onto which the dispensing nozzle 36 is screwed. This dispensing nozzle has a tip 54 closed by a lug 38. This lug 38 may be broken by the user at the moment of use of the packaging, in order to obtain an outlet 55 (FIG. 7) for the purpose of applying the mixture produced.

The connecting part 10 includes a collar 13 fastened onto the neck 7 of the bottle 6, for connecting the upper bottle 6 to the intermediate member 20. This connecting part 10, made of a rigid thermoplastic, includes a central hollow internal shaft 14 formed with a lower portion 44 of approximately cylindrical shape and surmounted by a portion 14*a* of gradually decreasing cross section. The decreasing section portion 14*a* terminates inside the bottle 6 in an upper end 15. This end 15 defines an orifice which is closed off, in storage position, as shown in FIG. 1, by another removable stopper 16. The stopper 16 is in the form of a circular dish which includes an annular groove 17 into which is forcibly engaged, in a sealed manner, the free edge of the upper end 15.

The stopper 16 can be separated from the end 15 by pushing axially along the X axis of the assembly. The portion 44 of the central hollow shaft 14 includes an internal screw thread 46 which can interact with the engagement means 48 of the intermediate member 20, the operation of which will be explained below. It should be noted that the total height of the intermediate member 20 is greater than the height of the central hollow shaft 14 in order to be able to ensure that the stopper 16 is correctly expelled.

The connecting part 10 includes a bridge 10*a* connected on the outside to the central hollow shaft 14 and also connected to an external trim skirt 10*b*, this connection being approximately half-way up the trim skirt 10*b*. This configuration defines an annular groove into which the neck 7 of the first container 6 is engaged.

The external skirt 10*b* is provided with an internal screw thread 10*c* which can interact with the external screw thread 9 on the neck 7 of the bottle 6. Moreover, the external skirt 10*b* has a shape allowing the external contours of the two bottles 6 and 8 to be brought into alignment.

For assembly and filling, the following procedures are carried out. As may be seen in FIG. 2, the intermediate member 20, pre-equipped with the plug 26, is firstly presented in an inverted orientation with respect to that shown in FIG. 1. Thus, the open end 30 of the plug 26 lies at the top, allowing the base composition $B_2$ to be introduced. The stopper 32 is then fastened onto this end 30, by snap-fastening. This stopper has a projecting external edge 33 and an inner sealing lip 33*a* which is applied against the internal wall of the tubular portion 28 of the plug. Thus, the base composition $B_2$ is contained, in a sealed manner, in the volume 34 bounded by the skirt 28 of the plug 26 and closed off by the stopper 32, the whole assembly being fitted onto the intermediate member 20.

Figure 3:
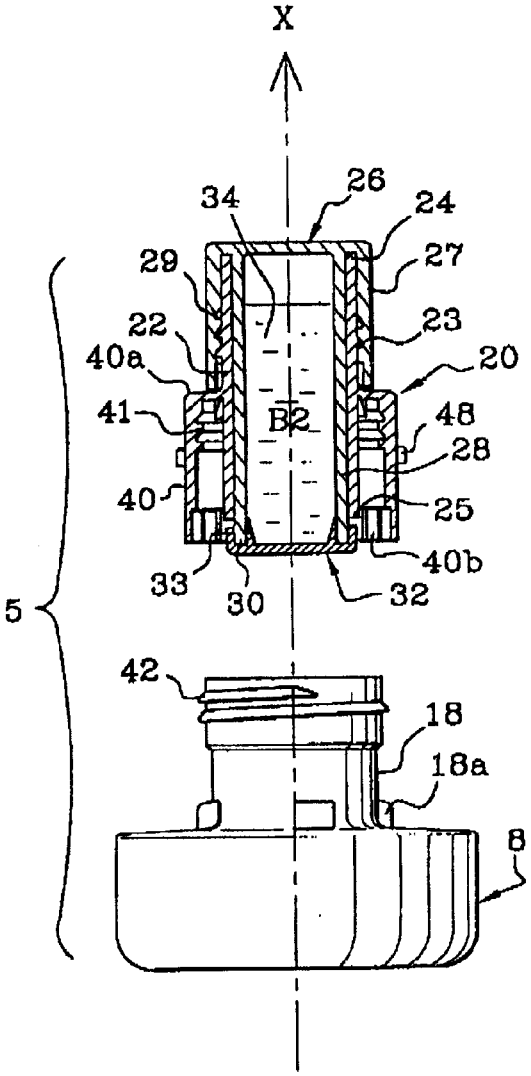
FIGS. 3 and 4 illustrate, in a partial axial sectional view, the way in which the intermediate member is fitted onto a lower container which contains another base composition $B_1$.
Figure 4:
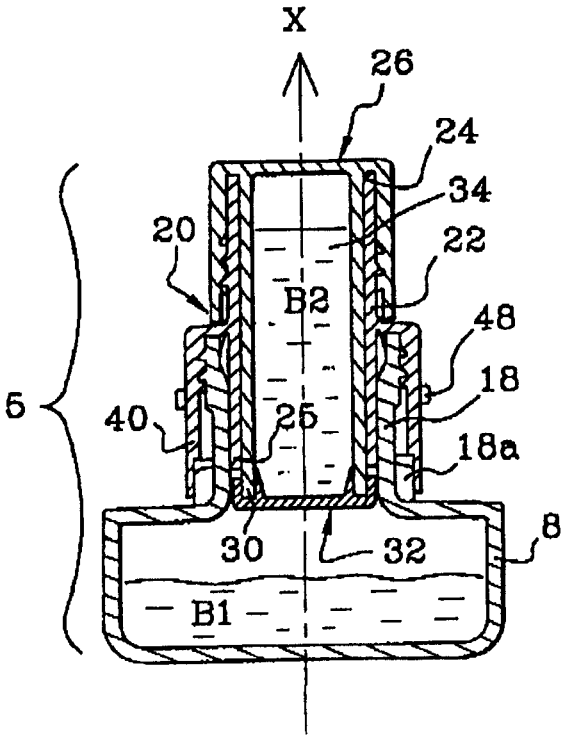

In FIG. 3, the subassembly 20, 26, 32 is shown in the position for fitting onto the neck 18 of the lower container 8. After the base composition $B_1$ has been introduced into the lower container 8, and after the intermediate member 20 has been screwed onto the neck of the lower container 8, the configuration shown in FIG. 4 results. It may be seen that the two base compositions $B_1$ and $B_2$ are contained in the bottle 5, but separated from each other by the stopper 32, the bottle 5 then being able to be handled completely safely.

Figure 5:
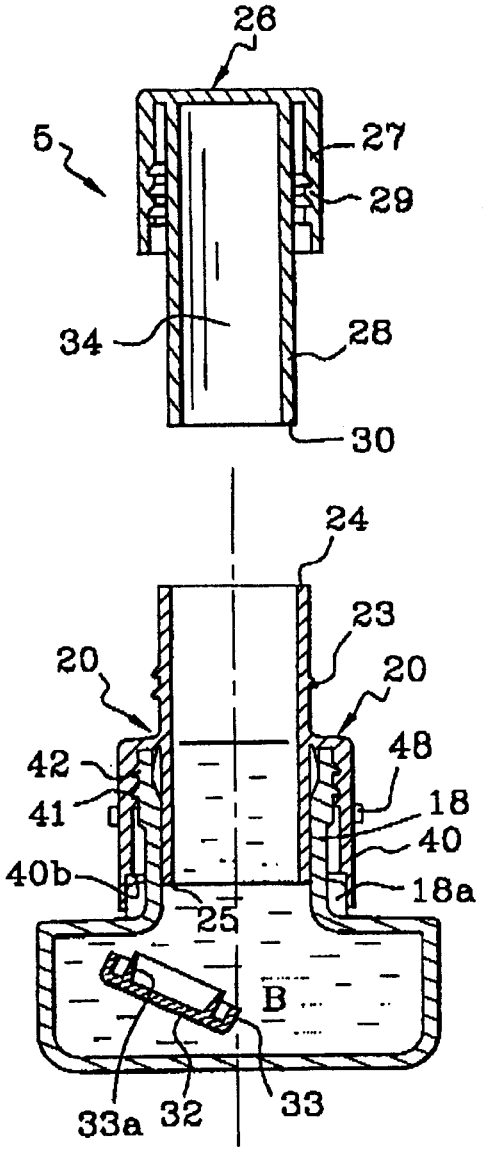
FIG. 5 shows an axial sectional view, illustrating the mixing of the two base compositions ($B_1$+$B_2$)
Figure 6:
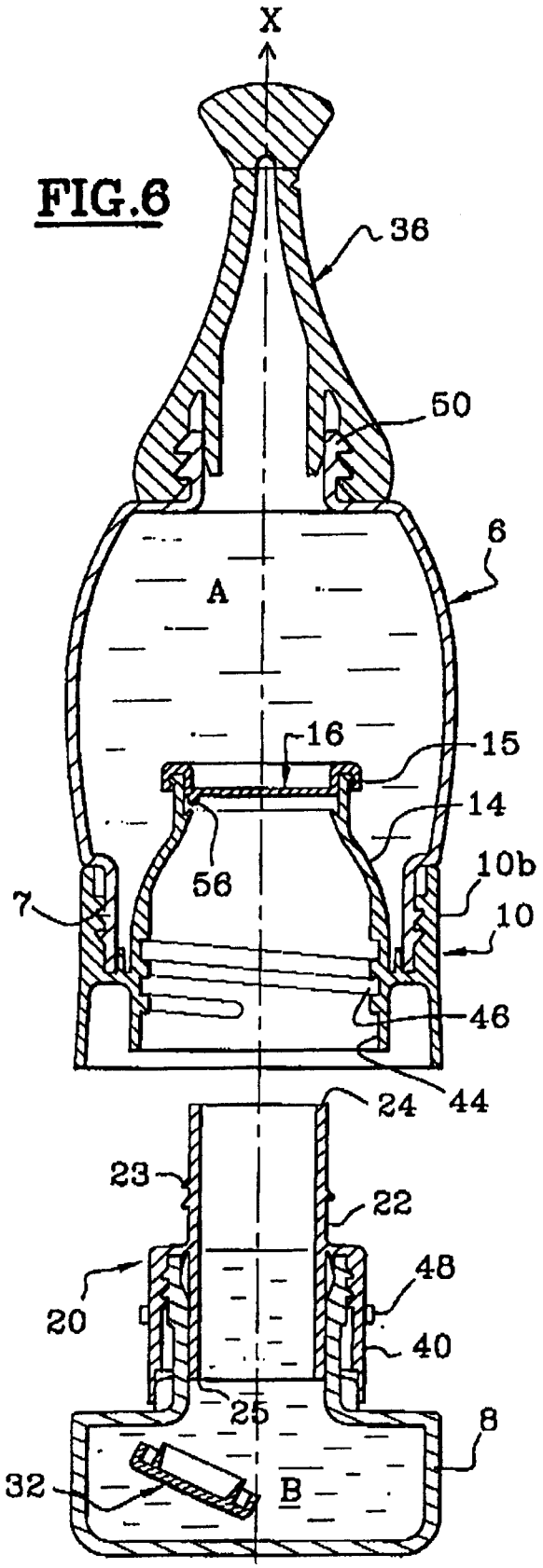
FIG. 6 shows an axial sectional view, illustrating how the first bottle is joined to the second bottle, via connecting part.
Figure 7:
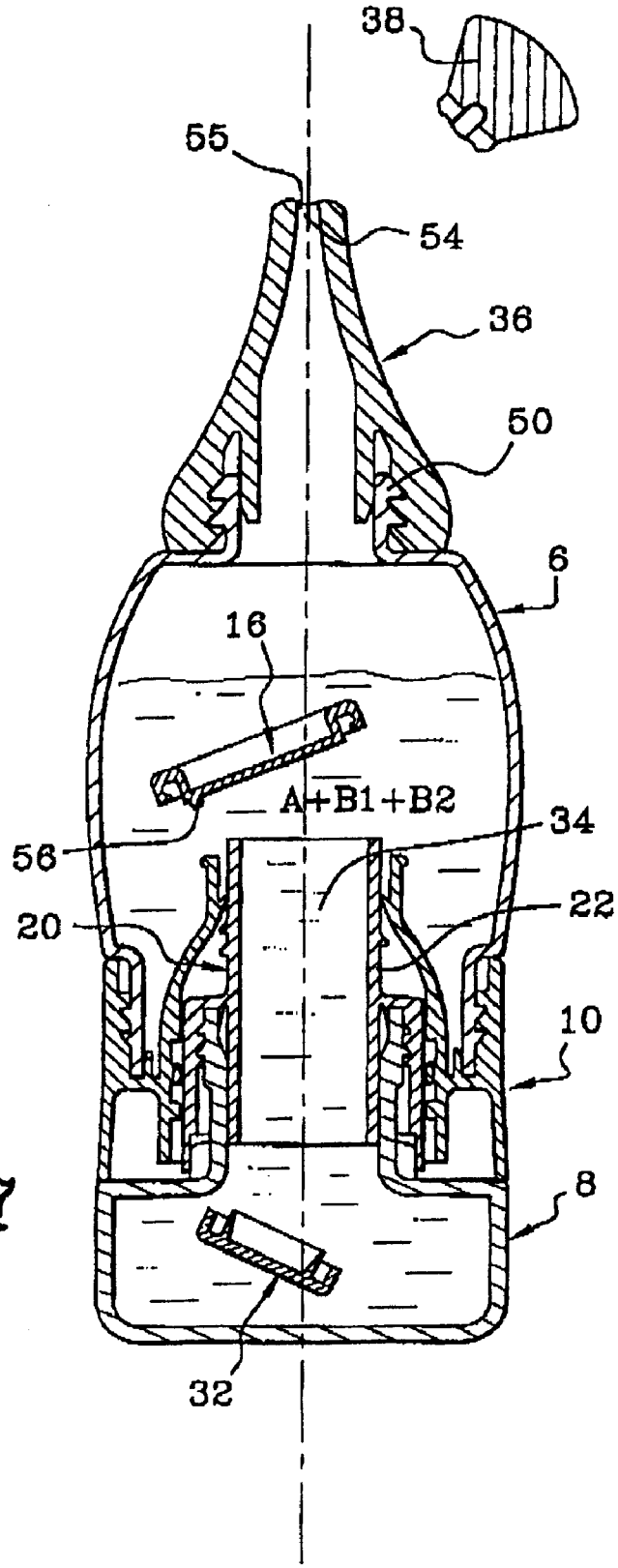
FIG. 7 shows an axial sectional view of the packaging in FIG. 1, in the ready-to-use position.

The operation of the packaging that has just been described is illustrated in FIGS. 5 to 7. In FIG. 5, the bottle 5 is shown in the open position. On unscrewing the plug 26, the tubular portion 28 rises axially inside the first skirt 22, bringing the peripheral edge 33 of the stopper 32 into abutment against the lower end 25 of the skirt 22. During this movement, the stopper is disengaged from the end 30 and drops into the container 8. The plug 26 is then withdrawn along the direction of the X axis of the bottle 5. Because of the presence of the abovementioned anti-unscrewing elements 18*a* and 40*b*, the intermediate member 20 remains securely attached to the lower container 8. The base composition $B_2$ then flows under gravity into the lower container 8, where it mixes with the base composition $B_1$ in order to form the product B.

In order to obtain the bottle 6 filled with product A, as shown in FIG. 6, the stopper 16 is firstly fastened, by snap-fastening, onto the free end 15 of the central hollow shaft 14 of the connecting part 10. By screwing the neck 7 onto the external skirt 10*b*, the bottle 6 is sealably fastened to the connecting part 10. The product A is then introduced through the upper neck 50. The bottle 6 is closed by screwing the nozzle 36 onto the neck 50.

In order to join the lower bottle 5 and upper bottle 6 together, the user then places the upper bottle 6 on the end 24 of the lower bottle 5. By making a screwing movement, the stubs 48 on the intermediate member 20 engage in the turns of the screw thread 46 on the central hollow shaft 14. After at least one screwing revolution, the end 24 bears against the stopper 16. It should be noted that a stud 56 may be provided on the lower face of the stopper 16, making it possible to initiate the disengagement of the latter from the upper end 15 of the central hollow shaft 14. By continuing the screwing movement, the stopper 16 is lifted off and expelled, as may be seen in FIG. 7, into the bottle 6. In this position, the containers 6, 8 and 34 are in communication with each other and the products A and B are mixed. By shaking the entire packaging, it is possible to ensure homogeneous mixing. Before the mixture thus obtained is applied at the desired point, the user removes the tip 38 by a twisting movement. By turning the whole assembly upside down, the dispensing nozzle 36 pointing downwards, a dose of the mixture is dispensed. This dispensing operation is particularly facilitated when the bottle 6 is compressible.

In accordance with the embodiment illustrated, the upper bottle 6 is made of a semi-rigid thermoplastic such as polyethylene or polypropylene. Thus, the upper bottle 6 may be compressed while dispensing the mixture. The dispensing nozzle 36, the intermediate member 20, the plug 26 and the connecting part 10 are made of a rigid polypropylene, for example. As regards the lower bottle 8, this is advantageously made of glass or of PVC (polyvinyl chloride) allowing an oxidation hair colorant precursor to be packaged under proper preservation conditions.

The stoppers 16 and 32 are advantageously made of a suitable semi-rigid thermoplastic.

In the preceding detailed description, reference was made to a preferred embodiment of the invention. It is obvious that variations can be made thereto without departing from the spirit of the invention as claimed hereinafter.

What is claimed:

1. Packaging for the extemporaneous mixing of two products, comprising:

a first bottle intended to contain a first product, said first bottle having an open base in the form of a skirt;

a dispensing nozzle fitted to said first bottle;

a connecting part mounted to the base of the first bottle, said connecting part comprising a central hollow shaft;

a detachable first stopper mounted to the connecting part, wherein the connecting part mounting the detachable first stopper closes the open base of the first bottle;

a second bottle intended to contain a second product, said second bottle being provided with a neck which can be engaged in said central hollow shaft of the connecting part, the second bottle bearing engagement means for engaging a complementary part provided in the central hollow shaft to cause said first stopper to be expelled and allow the two products to be mixed; and a removable closure mountable to close said second bottle and capable of separately holding a part of the second product when mounted to close said second bottle.

2. Packaging according to claim 1, wherein said second bottle comprises an intermediate member and a container having a neck, wherein said intermediate member has a first skirt with a free edge inserted into the neck of the container, further comprising a second stopper mounted to the removable closure so as to isolate the part of the second product in said removable closure when said removable closure is mounted to close said second bottle, wherein the free edge of the first skirt is positioned to dismount said second stopper from said removable closure when said removable closure is dismounted from said second bottle.

3. Packaging according to claim 2, wherein the first skirt includes a portion which emerges from the container, and which includes a screw thread which can interact with a corresponding screw thread carried by said removable closure.

4. Packaging according to claim 2, wherein said removable closure includes a tubular portion which extends inside the first skirt when said removable closure is mounted to close said second bottle and which has a free end to which said second stopper is mounted, the tubular portion and the second stopper defining a closed compartment which contains the isolated part of the second product.

5. Packaging according to claim 2, wherein the second stopper has a projecting peripheral edge which can butt against the free edge of the first skirt.

6. Packaging according to claim 2, wherein said engagement means is carried by said intermediate member.

7. Packaging according to claim 2, wherein said engagement means is carried by a second skirt of said intermediate member, which second skirt is outside of the neck of said container and an inner surface of which includes a screw thread capable of interacting with a corresponding screw thread formed on the neck of said container.

8. Packaging according to claim 7, wherein the engagement means comprise at least one stub projecting radially outward from said second skirt; and wherein said complementary part comprises at least one helical ramp provided on an internal surface of the central hollow shaft.

9. Packaging according to claim 8, wherein the engagement means comprise two diametrically opposed ones of said stubs, and said complementary part comprises two diametrically opposed ones of said helical ramps.

10. Packaging according to claim 2, further comprising elements which, after the intermediate member has been screwed on to the neck of the container, prevent said intermediate member from rotating with respect to the container.

11. Packaging according to claim 1, wherein the first stopper is snap-fastened onto the top of the central hollow shaft.

12. Packaging according to claim 2, wherein said first skirt expels said first stopper, further comprising a sealing lip on an internal surface of the top of the central hollow shaft so as to provide a seal between said internal surface of the top of the central hollow shaft and the first skirt when the first skirt is in position for expelling said first stopper.

13. Packaging according to claim 8, wherein interaction between the engagement means and the complementary part causes the intermediate member to move axially inside the central hollow shaft in response to rotation of the second bottle with respect to the first bottle, the pitch of the at least one helical ramp being such that an axial movement of the intermediate member sufficient for expelling the first stopper is obtained by rotating the second bottle through at least one turn with respect to the first bottle.

14. Packaging according to claim 7, wherein an internal diameter of the central hollow shaft is large enough to allow entry therein of at least part of said first cylindrical skirt and of at least part of said removable closure.

15. Packaging according to claim 11, wherein the connecting part comprises a member forming a U-shaped annular groove, said member comprising the central hollow shaft, an outer wall, and a bridge connecting the central hollow shaft to the outer wall, the central hollow shaft being extended by a smaller-diameter extension forming the top thereof, the internal surface of the outer wall including a screw thread capable of interacting with a corresponding screw thread provided on a base of the first bottle.

16. Packaging according to claim 1, wherein said dispensing nozzle is closed by a breakable tip.

17. Packaging according to the claim 1, wherein the first bottle is compressible.

18. Packaging according to claim 1, wherein the second bottle is made of a rigid thermoplastic and/or of glass.

19. Packaging according to claim 1, wherein the connecting member is made of a thermoplastic chosen from the group consisting of polyethylenes (PE), polypropylenes (PP), polyethylene terephthalates (PET), polyvinyl chlorides (PVC), and of a complex of the polyethylene/ethylene-vinyl alcohol (PE/EVOH) or PE/PET type.

20. Assembly according to claim 1, wherein the first product is an oxidizing agent and the second product is a colorant and an oil.

21. Packaging for the extemporaneous mixing of two products, comprising:

a first bottle intended to contain a first product, said first bottle having an open base in the form of a skirt;

a dispensing nozzle fitted to said first bottle;

a connecting part mounted to the base of the first bottle, said connecting part comprising a central hollow shaft;

a detachable first stopper mounted to the connecting part, wherein the connecting part mounting the detachable first stopper closes the open base of the first bottle;

a second bottle adapted to contain at least a part of a second product, said second bottle being provided with a neck which can be engaged in said central hollow shaft of the connecting part, the second bottle bearing engagement means for engaging a complementary part provided in the central hollow shaft to cause said first stopper to be expelled and allow the first and second products to be mixed; and a removable closure mountable to close said second bottle, said removable closure forming a compartment capable of holding another part of the second product, wherein said removable closure is adapted to hold the another part of the second product separate from the part of the second product to be contained in the second bottle, when the removable closure is mounted to close said second bottle.

22. Packaging for the extemporaneous mixing of two products, comprising:

a first bottle intended to contain a first product, said first bottle having an open base in the form of a skirt;

a dispensing nozzle fitted to said first bottle;

a connecting part mounted to the base of the first bottle, said connecting part comprising a central hollow shaft;

a detachable first stopper mounted to the connecting part, wherein the connecting part mounting the detachable first stopper closes the open base of the first bottle;

a second bottle adapted to contain at least a part of a second product, said second bottle being provided with a neck which can be engaged in said central hollow shaft of the connecting part, the second bottle bearing an engagement portion adapted to engage a complementary part provided in the central hollow shaft to cause said first stopper to be expelled and allow the first and second products to be mixed; and a removable closure mountable to close said second bottle, said removable closure forming a compartment capable of holding another part of the second product, wherein said removable closure is adapted to hold the another part of the second product separate from the part of the second product to be contained in the second bottle, when the removable closure is mounted to close said second bottle.

* * * * *